US006416202B1

(12) United States Patent
Masuda et al.

(10) Patent No.: US 6,416,202 B1
(45) Date of Patent: Jul. 9, 2002

(54) VEHICLE LAMP

(75) Inventors: Susumu Masuda; Yasuaki Funada, both of Shizuoka (JP)

(73) Assignee: Koito Manufacturing Co., Ltd. (JP)

( * ) Notice: Subject to any disclaimer, the term of this patent is extended or adjusted under 35 U.S.C. 154(b) by 0 days.

(21) Appl. No.: 09/705,112

(22) Filed: Nov. 2, 2000

(30) Foreign Application Priority Data

Nov. 2, 1999 (JP) ..... 11-312574

(51) Int. Cl.[7] ..... F21V 29/00
(52) U.S. Cl. ..... 362/267; 362/311; 362/507
(58) Field of Search ..... 362/267, 307, 362/310, 311, 507, 455, 459, 335

(56) References Cited

U.S. PATENT DOCUMENTS 5,448,454 A * 9/1995 Nonka ..... 362/61
5,552,970 A 9/1996 Takezawa et al. ..... 362/61
5,562,338 A 10/1996 Yamamoto ..... 362/61
5,765,942 A * 6/1998 Shirai et al. ..... 362/267
6,045,247 A 4/2000 Fukuhara ..... 362/543

* cited by examiner

*Primary Examiner*—Sandra O'Shea
*Assistant Examiner*—Ali Alaui
(74) *Attorney, Agent, or Firm*—Fish & Richardson PC

(57) ABSTRACT

An outer peripheral wall **14*b*1 of an attachment groove 14*b* of a lamp body 14 is branched for vard into two branch walls 14*b*1A, 14*b*1B in the portion located on the side of a right end 16A of a front lens 16. Thus, the inner branch wall 14*b*1A can be set to have such a relatively small open angle that can prevent a sealant 20 from running off onto its outer periphery upon insertion of an attachment leg 16*a* into the attachment groove 14*b*, whereas the outer branch wall 14*b*1**B can be set to have a large open angle according to the requirements of the lamp design and the like.

7 Claims, 3 Drawing Sheets

VEHICLE LAMP

FIELD OF THE INVENTION

The present invention relates to a vehicle lamp, and more particularly, to an attachment structure of a front lens and lamp body of the vehicle lamp.

BACKGROUND OF THE INVENTION

As shown in FIG. 3, in many vehicle lamps, a lamp body 2 has an attachment groove 2*a* formed along the peripheral edge of a lamp chamber, and a front lens 4 has an attachment leg 4*a* formed at the position facing the attachment groove 2*a*. The lamp body 2 and the front lens 4 are assembled together by inserting the attachment leg 4*a* into the attachment groove 2*a* having a sealant 8 applied therein. In view of the mold draft angle in molding the lamp body 2, the attachment groove 2*a* is formed to be somewhat widened from its bottom toward upper end. However, according to the requirements of the lamp design and the like, an outer peripheral wall 2*al* thereof is often opened partially at a relatively large angle toward the upperend.

However, as shown in FIG. 3, if the outer peripheral wall 2*al* of the attachment groove 2*a* is opened at an excessively large angle, the sealant 8 applied within the attachment groove 2*a* runs off onto its outer peripheryl upon insertion of the attachment leg 4*a* into the attachment groove 2*a*. This makes it difficult to assure sufficient sealing between the lamp body 2 and the front lens 4.

The present invention is made in view of the foregoing. An objective of the present invention is to provide a vehicle lamp capable of assuring sufficient sealing between a lamp body and a front lens even if an open angle of an outer peripheral wvall of an attachment groove of the lamp body is partially set to a large value.

SUMMARY OF THE INVETNION

The present invention achieves the above-mentioned objective bv devising a structure of the outer peripheral wall of the attachment groove.

Specifically, a vehicle lamp according to an embodiment of the present invention includes a lamp body having an attachment groove formed along a peripheral edge of a lamp chamber and a front lens having an attachment leg formed at a position facing the attachment groove. The lamp body and the front lens are assembled together by inserting the attachment leg into the attachment groove having a sealant applied therein. An outer peripheral wvail of the attachment groove is partially branched forward into two branch walls.

The "branch wall" is not particularly limited in terms of its specific shape, position in the outer peripheral wall of the attachment groove, and the like, as long as the outer peripheral wall is branched forward into two branch walls.

As shown in the above structure, the vehicle lamp according to an embodiment of the present invention is structured such that the lamp body and the front lens are assembled together by inserting the attachment leg of the front lens into the attachment groove of the lamp body with the sealant applied therein. However, since the outer peripheral wall of the attachment groove is partially branched forwvard into two branch walls, the following can be obtained.

Specifically, by forming a part of the outer peripheral wall as the branch walls, the inner branch wall can be set to have a relatively small open angle for preventing the sealant from running off onto its outer periphery upon insertion of the attachment leg into the attachment groove. The outer branch wall can be set to have a large open angle according to the requirements of the lamp design and the like.

Therefore, according to an embodiment of the present invention, sufficient sealing between the lamp body and the front lens can be assured even if the open angle of the outer peripheral wall of the attachment groove of the lamp body is partially set to a large value.

If the front lens is curved backward from its one end toward the other end in such a structure, the respective mold draft directions of the lamp body and the front lens are usually set to incline With respect to the longitudinal direction of the lamp. Moreover, the respective mold draft directions of the lamp body and the front lens are often different from each other. Therefore, in the attachment groove of the lamp body, the open angle of the outer peripheral wall ofien needs to be set to a large value at the one end. In such a case, it is particularly effective to form the branch walls on the side of the one end.

Furthermore, a rim of a vehicle body extending approximately in the longitudinal direction is often provided adjacent to the lamp body on the side of the one end, according to the requirements of the lamp design. However, since the outer peripheral wall of the attachment groove of the lamp body is branched into the branch walls at the one end, the outer surface thereof can be easily made approximately flush and continuous with the outer surface of the front end of the rim. With such a structure, the appearance of the lamp can be improved.

DETAILED DESCRIPTION OF THE INVENTION

Hereinafter, an embodiment of the present invention will be described with reference to the drawings.

Figure 1:
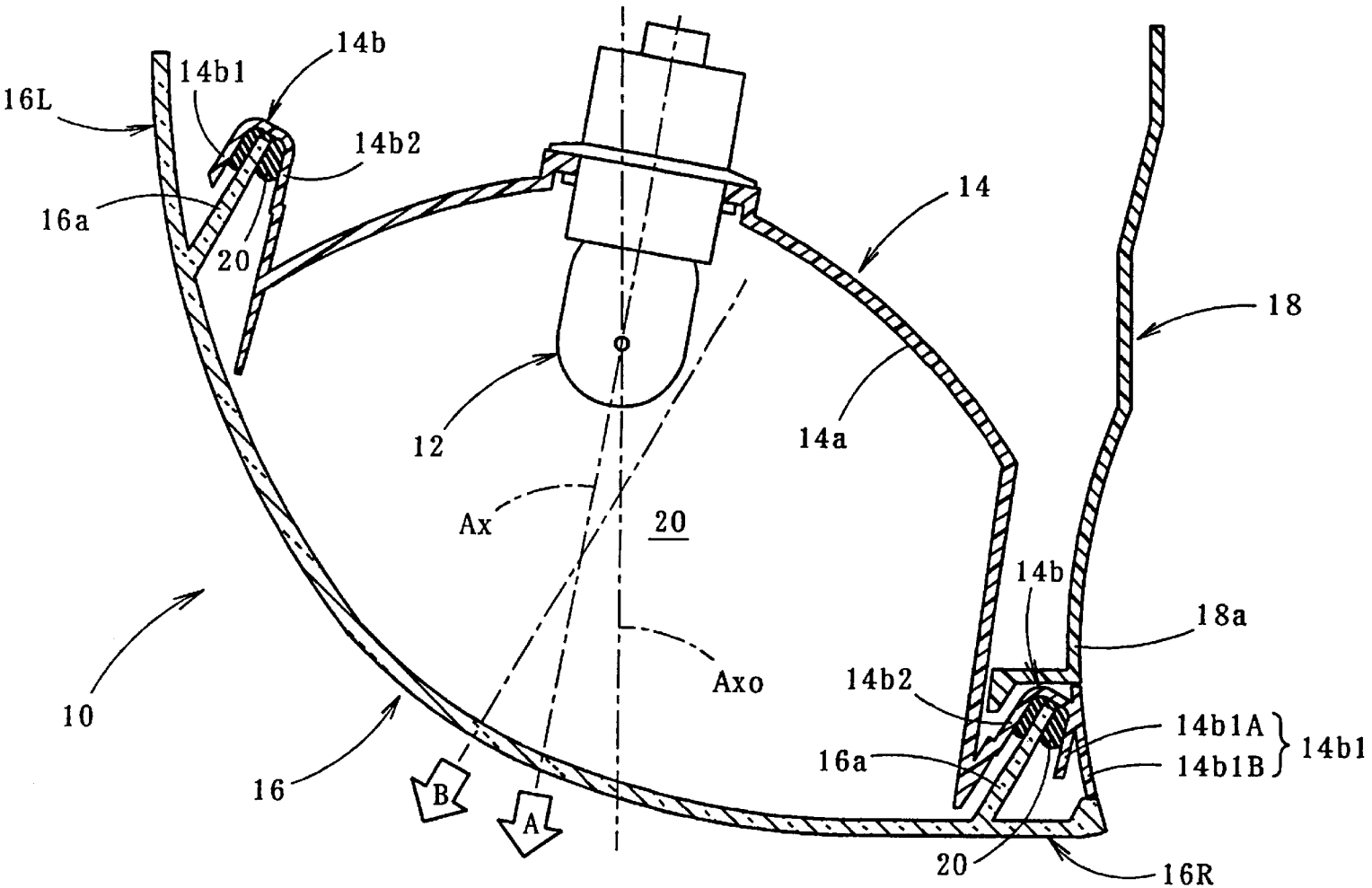
FIG. 1 is a cross-sectional view showing a vehicle lamp according to one embodiment of the present invention.
Figure 2:
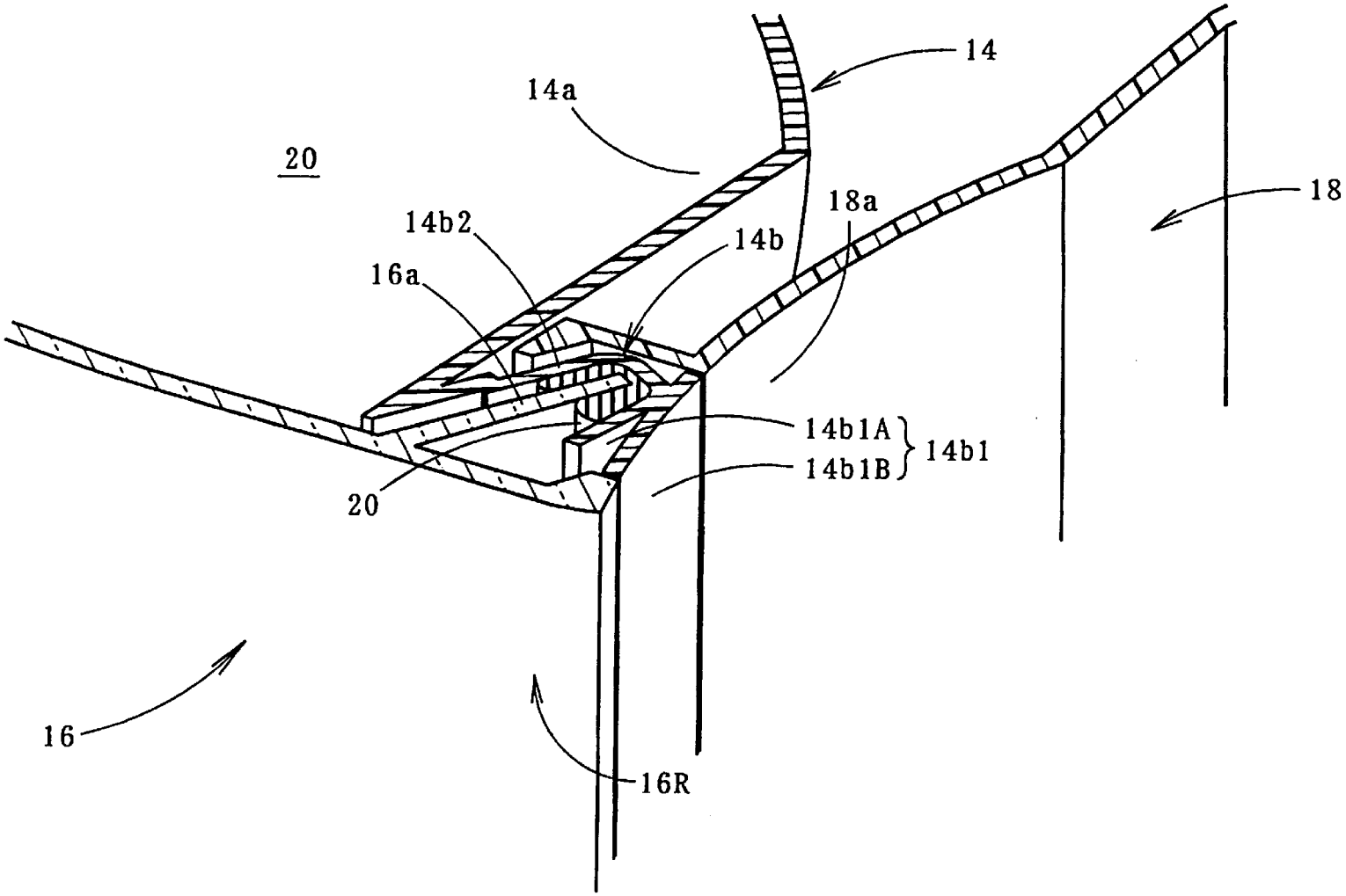
FIG. 2 is a sectional perspective view showing a part of the vehicle lamp according to an embodiment of the present invention.
Figure 3:
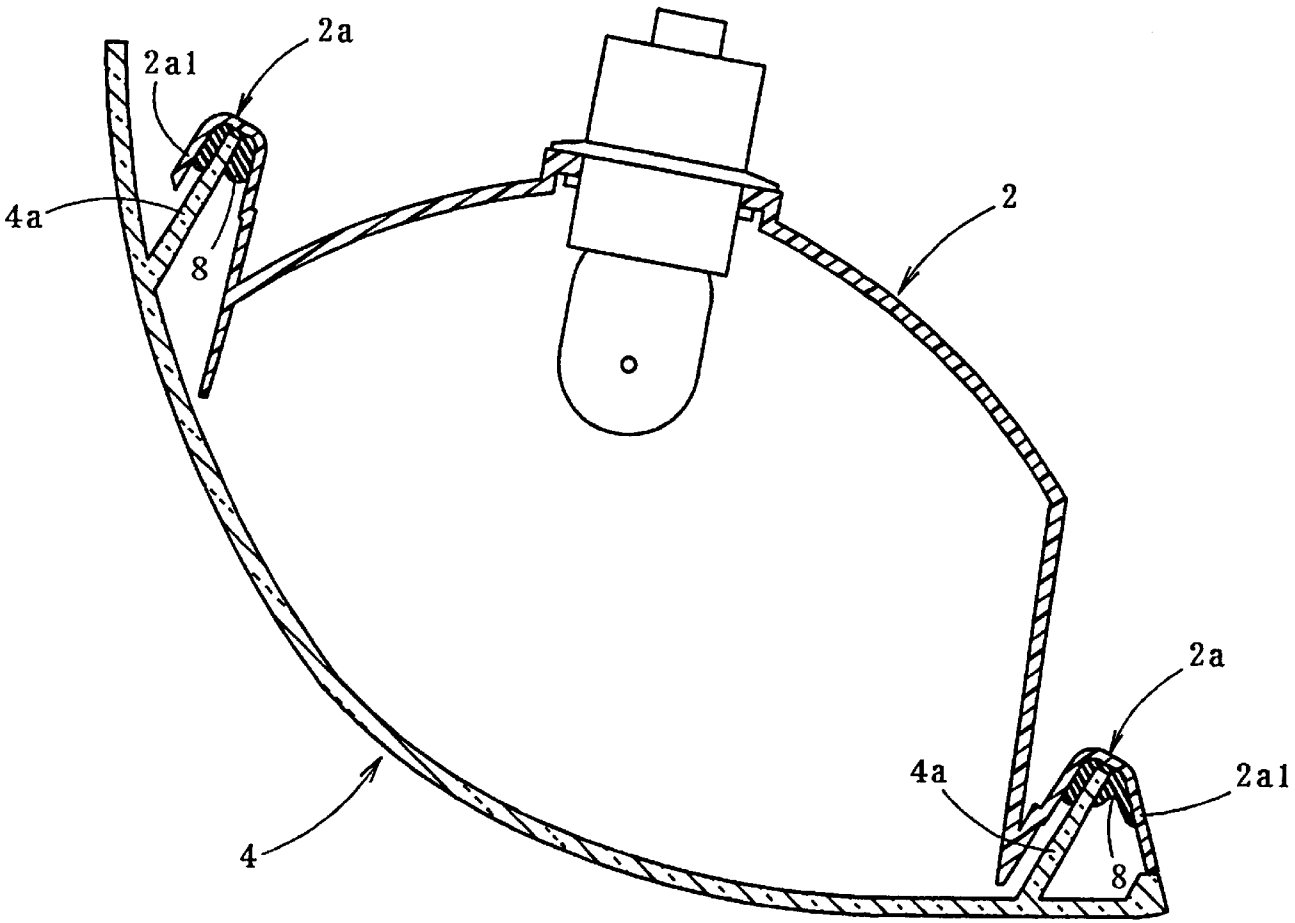
FIG. 3 PRIOR ART
FIG. 3 shows a cross-sectional view of a conventional vehicle lamp.

FIG. 1 is a cross-sectional view showing a vehicle lamp 10 according to one embodiment of the present invention, and FIG. 2 is a sectional perspective view showing a part thereof.

As shown in the Fioures, the vehicle lamp 10 is a tail lamp provided at the left rear end of a vehicle body, and includes a light-source bulb 12, a lamp body 14, a front lens 16 and a rim 18 of the vehicle body. The lamp body 14 and the front lens 16 form a lamp chamber 20.

The lamp body 14 has an optical axis Ax that is inclined to the left toward the rear of the vehicle body with respect to an axis Axo, which extends in the longitudinal direction of the vehicle body. A reflecting surface 14*a* for reflecting light forwardly from the light-source bulb 12 mounted on the lamp body 14 (which means forward with respect to the lamp, and backward with respect to the vehicle body; the rest is the same as follows) is provided around the optical axis Ax. The lamp body 14 has an attachment groove 14*b* formed along the entire peripheral edge of the lamp chamber 20.

The front lens 16 is curved backward from its right end 16R toward left end 16L, and has an attachment leg 16*a* formed along the entire periphery at the position facing the attachment groove 14*a* of the lamp body 14. The front lens 16 is assembled with the lamp body 14 by inserting the attachment leg 16*b* into the attachment groove 14*b* of the lamp body 14 with a sealant 20 applied within the attachment groove 14*b*.

The rim 18 is a member extending approximately longitudinally along the vertical plane, and is provided adjacent to the lamp body 14 on the side of the right end 16R.

The lamp body 14 and the front lens 16 are injection-molded parts. The mold draft direction of the lamp body 14 is set in the direction shown by the arrow A. which is the same as the optical axis Ax. On the other hand, since the front lens 16 is curved backward from its right end 16R toward left end 16L, the mold draft direction of the front lens 16 is set to the direction shown by the arrow B that is oriented to the left with respect to the arrow A.

At the left end 16L, an outer peripheral wall 14*b*1 of the attachment groove 14*b* of the lamp body 14 extends approximately in the direction of the arrow B, and an inner peripheral wall 14*b*2 thereof extends approximately in the direction of the arrow A. However, at the right end 16R, the inner peripheral wall 14*b*2 extends approximately in the direction of the arrow B, and the outer peripheral wall 14*b*1 is branched forward into two branch walls 14*b*1A, 14*b*1B.

The inner branch wall 14*b*1A of the branch walls 14*b*1A, 14*b*1B extends approximately in the direction of the arrow A, and the outer branch wall 14*b*1B thereof extends in the direction that is oriented to the right with respect to the axis Axo extending in the longitudinal direction of the vehicle body. The outer branch wall 14*b*1B has a slightly concave outer surface in horizontal cross section.

The outer surface of a front end 18*a* of the rim 18 is approximately flush and continuous with the outer surface of the outer branch wall 14*b*1B. The right end face of the right end 16R of the front lens 16 is also approximately flush and continuous with the outer surface of the outer branch wall 14*b*1B.

As has been described above in detail, the vehicle lamp 10 according to the present embodiment is structured such that the lamp body 14 and the front lens 16 are assembled together by inserting the attachment leg 16*a* of the front lens 16 into the attachment groove 14*b* of the lamp body 14 with the sealant 20 applied therein. However, since the outer peripheral wall 14*b*1 of the attachment groove 14*b* is partially branched forward into two branch walls 14*b*1A, 14*b*1B, the following can be obtained.

Specifically, by forming a part of the outer peripheral wall 14*b*1 as the branch walls 14*b*1A, 14*b*1B, the inner branch wall 14*b*1A can be set to have such a relatively small open angle that can prevent the sealant 20 from running off onto its outer periphery upon insertion of the attachment leg 16*a* into the attachment groove 14*b*. The outer branch wal 14*b*1B can be set to have a large open angle according to the requirements of the lamp design and the like.

Therefore, according to the present embodiment, sufficient sealing between the lamp body 14 and the front lens 16 can be assured even if the open angle of the outer peripheral wall 14*b*1 of the attachment groove 14*b* of the lamp body 14 is partially set to a large value.

In the vehicle lamp 10 according to the present embodiment, the front lens 16 is curved backward from its right end 16R toward left end 16L. Accordingly, the respective mold draft directions A, B of the lamp body 14 and the front lens 16 are set to incline to the left with respect to the axis Axo extending in the longitudinal direction of the lamp. Moreover, these mold draft directions A, B are different from each other. Therefore, in the attachment groove 14*b* of the lamp body 14, the open angle of the outer peripheral wall 14*b*1 is set to a very large value at the right end 16R. In such a case, it is effective to have the outer peripheral wall 14*b*1 of the attachment groove 14*b* branched into the branch walls 14*b*1A, 14*b*1B at the right end 16R as in the present embodiment.

Moreover, in the present embodiment, the rim 18 extending approximately in the longitudinal direction is provided adjacent to the lamp body 14 on the side of the right end 16R. However, since the outer peripheral wall 14*b*1 of the attachment groove 14*b* of the lamp body 14 is branched into the branch walls 14*b*1A, 14*b*1B at the right end 16R, the outer surface of the outer branch wall 14*b*1B can be easily made approximately flush and continuous with the outer surface of the front end 18*a* of the rim 18. Since the present embodiment adopts such a structure, the appearance of the lamp can be improved.

In the above embodiment, the vehicle lamp 10 is a tail lamp. However, by adopting the same structure as that of the above embodiment, the same effects as those of the above embodiment can be obtained also in other vehicle lamps such as beacon light and headlamp.

The present invention claims priority from Japanese patent application serial no. H11-312574, which is incorporated herein by this reference in its entirety.

Several embodiments of the invention have been described herein, but it should be understood that various additions and modifications could be made which fall within the scope of the following claims.

What is claimed is:

1. A vehicle lamp comprising:

a lamp body;

a groove comprising an inner peripheral wall and an outer peripheral wall formed along the edge of the lamp body; and a front lens having a leg formed at a position facing the groove;

wherein the lamp body and the front lens are assembled together by inserting the leg between the inner peripheral wall and the outer peripheral wall of the groove having a sealant therein; and an outer peripheral wall of the groove is partially branched forward into an outer wall and an inner wall; the outer wall is arranged to be substantially flush and continuous with an end of the front lens.

2. The vehicle lamp according to claim 1, wherein the front lens is curved outward from one end toward the other end of the front lens, and the branch walls of the groove are formed on a side of the one end.

3. The vehicle lamp according to claim 1, wherein a rim is provided adjacent to the lamp body on the side of the one end, and an outer surface of a front end of the rim and an outer surface of the branch wall are approximately flush and continuous with each other.

4. The vehicle lamp according to claim 2, wherein a rim is provided adjacent to the lamp body on the side of the one end, and an outer surface of a front end of the rim and an outer surface of the branch wall are approximately flush and continuous with each other.

5. A vehicle lamp comprising:

a lamp body;

a groove formed along the edge of the lamp body, having an inner peripheral wall and an outer peripheral wall that branches into an inner wall and an outer wall at one side of the lamp body; and a front lens having a leg formed to face the groove;

wherein the lamp body and the front lens are assembled together by inserting the leg into the groove having a sealant therein, wherein the leg is inserted between the inner peripheral wall and the inner wall at one side of the lamp body; the outer wall is arranged to be substantially flush and continuous with an end of the front lens.

6. The vehicle lamp according to claim 5 further comprising:

a rim in flush With the outer wall of the groove at one side of the lamp body.

7. The vehicle lamp according to claim 5 wherein the lamp body has a substantially concave reflecting surface with a light source disposed on the reflecting surface.

* * * * *